US005081897A

United States Patent [19]

Takauji

[11] Patent Number: 5,081,897

[45] Date of Patent: Jan. 21, 1992

[54] ELECTRONIC MUSICAL INSTRUMENT HAVING WAVEFORM MEMORY

[75] Inventor: Kiyomi Takauji, Shizuoka, Japan

[73] Assignee: Kabushiki Kaisha Kawai Gakki Seisakusho, Shizuoka, Japan

[21] Appl. No.: 479,492

[22] Filed: Feb. 13, 1990

[30] Foreign Application Priority Data

Feb. 20, 1989 [JP] Japan ..... 1-39768
Feb. 26, 1989 [JP] Japan ..... 1-44270
Feb. 26, 1989 [JP] Japan ..... 1-44271

[51] Int. Cl.[5] ..... G10H 7/00
[52] U.S. Cl. ..... 84/604
[58] Field of Search ..... 84/604–608

[56] References Cited

U.S. PATENT DOCUMENTS 4,646,608 3/1987 Deutsch ..... 84/608

*Primary Examiner*—Stanley J. Witkowski
*Attorney, Agent, or Firm*—Sughrue, Mion, Zinn, Macpeak & Seas

[57] ABSTRACT

An electronic musical instrument includes a decimal point position converting device for dividing an address corresponding to key information into an integer portion address and a decimal point portion address, the integer portion address being readout and sent to a waveform data memory as a read address, wherein a bit number of the address for access to the waveform data memory is changed correspondingly to a respective musical sound generators. An address control circuit converts the address corresponding to the key information into an address format in a location of the waveform data memory in which the desired waveform data is stored, and a data format converter circuit converts a data format of the desired waveform data readout from the waveform data memory so that the data readout from the waveform data memory is converted correspondingly to a respective one of the musical sound generators. A status memory stores control data for controlling operations of the decimal point position converting circuit, the address control circuit and the data format converter circuit.

6 Claims, 15 Drawing Sheets

FIG. 3

| TYPE OF MEMORY \ OUTPUT OF 12 | MA23 | MA22 | MA21 | MA20 | MA19 | MA18 | MA17 | MA16 | MA15 | MA14 | MA13 | MA12 | MA11 | MA10 | MA9 | MA8 | MA7 | MA6 | MA5 | MA4 | MA3 | MA2 | MA1 | MA0 |
|---|---|---|---|---|---|---|---|---|---|---|---|---|---|---|---|---|---|---|---|---|---|---|---|---|
| ROMAND SRAM | AB23 | AB22 | AB21 | AB20 | AB19 | AB18 | AB17 | AB16 | AB15 | AB14 | AB13 | AB12 | AB11 | AB10 | AB9 | AB8 | AB7 | AB6 | AB5 | AB4 | AB3 | AB2 | AB1 | AB0 |
| FRONT HALF D·RAM(I) | AB23 | AB22 | AB21 | AB20 | AB19 | AB18 | AB17 | AB16 | X | X | X | X | X | X | X | X | AB7 | AB6 | AB5 | AB4 | AB3 | AB2 | AB1 | AB0 |
| REAR HALF D·RAM(I) | | | | | | | | | | | | | | | | | AB15 | AB14 | AB13 | AB12 | AB11 | AB10 | AB9 | AB8 |
| FRONT HALF D·RAM(II) | AB23 | AB22 | AB21 | AB20 | AB19 | AB18 | X | X | X | X | X | X | X | X | X | AB8 | AB7 | AB6 | AB5 | AB4 | AB3 | AB2 | AB1 | AB0 |
| REAR HALF D·RAM(II) | | | | | | | | | | | | | | | | AB17 | AB16 | AB15 | AB14 | AB13 | AB12 | AB11 | AB10 | AB9 |

MA23~0 : OUTPUT OF ADDRESS CONTROL CKT 12
AB23~0 : OUTPUT OF ACCUMULATION CKT 7

| OUTPUT OF 11-1 / FS | ABB 23 | ABB 22 | ABB 21 | ABB 20 | ABB 19 | ABB 18 | ABB 17 | ABB 16 | ABB 15 | ABB 14 | ABB 13 | ABB 12 | ABB 11 | ABB 10 | ABB 9 | ABB 8 | ABB 7 | ABB 6 | ABB 5 | ABB 4 | ABB 3 | ABB 2 | ABB 1 | ABB 0 |
|---|---|---|---|---|---|---|---|---|---|---|---|---|---|---|---|---|---|---|---|---|---|---|---|---|
| "L" | TCC 7 | TCC 6 | TCC 5 | TCC 4 | TCC 3 | TCC 2 | TCC 1 | TCC 0 | F 31 | F 30 | F 29 | F 28 | F 27 | F 26 | F 25 | F 24 | F 23 | F 22 | F 21 | F 20 | F 19 | F 18 | F 17 | F 16 |
| "H" | TCC 3 | TCC 2 | TCC ⋮ | TCC 0 | F 31 | F 30 | F 29 | F 28 | F 27 | F 26 | F 25 | F 24 | F 23 | F 22 | F 21 | F 20 | F 19 | F 18 | F 17 | F 16 | F 15 | F 14 | F 13 | F 12 |

FIG. 16

| OUTPUT / P | WD 31 | WD 30 | WD 29 | WD 28 | --- | --- | | | | | | |
|---|---|---|---|---|---|---|---|---|---|---|---|---|
| 0 | M15 | M14 | M13 | M12 | | | M1 | M0 | 0 | 0 | 0 | 0 |
| 1 | 0 | M15 | M14 | M13 | M12 | | M2 | M1 | M0 | 0 | 0 | 0 |
| 2 | 0 | 0 | M15 | M14 | M13 | | M3 | M2 | M1 | M0 | 0 | 0 |
| 3 | 0 | 0 | 0 | M15 | M14 | M13 | M4 | M3 | M2 | M1 | M0 | 0 |
| ----- | | | | | | | | | | | | |

ELECTRONIC MUSICAL INSTRUMENT HAVING WAVEFORM MEMORY

BACKGROUND OF THE INVENTION

The present invention relates to an electronic musical instrument having a waveform data memory.

An electronic musical instrument having a memory storing various waveform data corresponding to tones and range (or pitch) has been known in which a read address is assigned to every musical sound generator for picking up waveforms to be generated thereby. FIG. 1 is a block circuit of such an electronic musical instrument. In FIG. 1, a reference numeral 1 depicts a key/-tone selection switch, 2 an assigning circuit for the switch 1, 3 an execution control circuit, 4 a waveform data memory, 5 a bank code memory, 6 a frequency number circuit, 7 a frequency number accumulation circuit, 8 an envelope waveform circuit, 9 a multiplier circuit and 10 a sound circuit.

The key/tone switch 1 comprises a set of switches which selects positions of keys depressed by a player and tones corresponding thereto. The assigning circuit 2 electrically scans the set of switches of the key/tone switch 1, internally assigns an information obtained according to on or off state of each switch and sends it to the execution control circuit 3 as a key information and a tone information. The execution control circuit 3 contains a central processing circuit which performs processings such as read address generation for reading waveform data from the waveform data memory 4 according to the key and tone informations in the manner to be described later. The waveform data memory 4 stores various waveform data corresponding to tones and pitches in respective memory locations. The waveform data memory 4 is composed of a plurality of memory banks or regions whose size, i.e., memory capacity are fixed. The memory banks are made correspondent to tones and pitches, respectively, so that, in order to generate a certain musical sound, one of the memory banks of the memory 4 is selected by the bank code memory 5 and then a read address range corresponding to the key information is appointed by the frequency number circuit 6 and the accumulation circuit 7. Waveform data is readout from the waveform data memory 4 according to the address determined by the bank code memory 5, the frequency number circuit 6 and the accumulation circuit 7. The readout waveform data is multiplied by the multiplier circuit 9 with an output of the envelope waveform circuit 8 and digital-analog converted by the sound circuit 10, resulting in the desired musical sound signal.

The term "frequency number" useo herein corresponds to a period of reading the waveform data memory and is referred to as "high" when data stored in the waveform data memory 4 is readout at a short period. The frequency number circuit provides a clock signal by which the reading period is determined.

The waveform data memory 4 may be constituted with a read only memory (ROM), a static random access read/write memory (S-RAM) and/or a dynamic random access read/write memory (D-RAM). The data storage devices, their use in a system and the data reading operations of these memories are different and, particularly, the address system for the D-RAM is much different from those of the others. Therefore, when, in order to enable arbitrary change of the memories correspondingly to the musical sound generators, a special address circuit must be used separately. Thus, the system construction becomes large.

Further, the size of each bank of the waveform data memory 4 in FIG. 1 is preliminarily fixed and thus the maximum number of address bits for reading one bank is fixed in the system. This means that, when a waveform data from a certain musical sound generator is special and so the data region should be expanded, it is very difficult to accommodate thereto due to the limited number of address bits. That is, in order to expand a certain bank of the memory 4, the latter must have a large memory capacity causing the number of bits necessary to access thereto to be increased. In other words, since the memory banks of usual size are used by corresponding ones of the musical sound generators, it is impossible to increase the number of address bits so that other musical sound generators can use even memory banks which are free.

Further, there may be a case where bit length of waveform data can be smaller depending upon a desired tone and pitch and there may be a case where there are several waveform data types, i.e., linear, exponential and differential data expressions and waveform data of such types are stored in the waveform data memory 4 in mixed state.

Since the conventional waveform data memory uses a common data system, some of data expressions can not be waveform-transformed in processing with the envelope waveform after readout from the waveform data memory.

SUMMARY OF THE INVENTION

An object of the present invention is to provide an electronic musical instrument having an address control circuit capable of providing address types corresponding to various types of waveform data memory so that it is possible to accommodate every musical sound generator.

Another object of the present invention is to provide an electronic musical instrument capable of reading waveform data while changing the number of address bits correspondingly thereto, without increasing the size of a waveform data memory substantially.

A further object of the present invention is to provide an electronic musical instrument which includes a waveform data memory storing waveform data of types optimum for tone and pitch and which can process the data types after readout from the waveform data memory by transforming them correspondingly to musical sound generators.

The above objects can be achieved according to the present invention by a provision of an electronic musical instrument which comprises a switch means including a plurality of key switches and a plurality of tone selection switches, a control circuit responsive to a key/tone information obtained by scanning these switches for producing various control signals, a frequency number circuit for storing frequency numbers corresponding to the key information in correspondence to a plurality of respective musical sound generators, an accumulator means for accumulating output values of the frequency number circuit, data stored preliminarily in a waveform data memory being readout by using addresses corresponding to the key information to generate desired musical sound from the musical sound generators, and an address control circuit for transforming the address type corresponding to the key information to a predetermined address type used in a location of the waveform data memory in which the desired waveform data is stored, the address control circuit being controlled by the control circuit to change the type of address for access to the waveform data memory correspondingly to every musical sound generator.

BRIEF DESCRIPTION OF THE DRAWINGS

FIG. 3 is a table of address outputs of various types of memories;

FIG. 16 is an example of data format conversion;

DETAILED DESCRIPTION OF THE PREFERRED EMBODIMENTS

Figure 1:
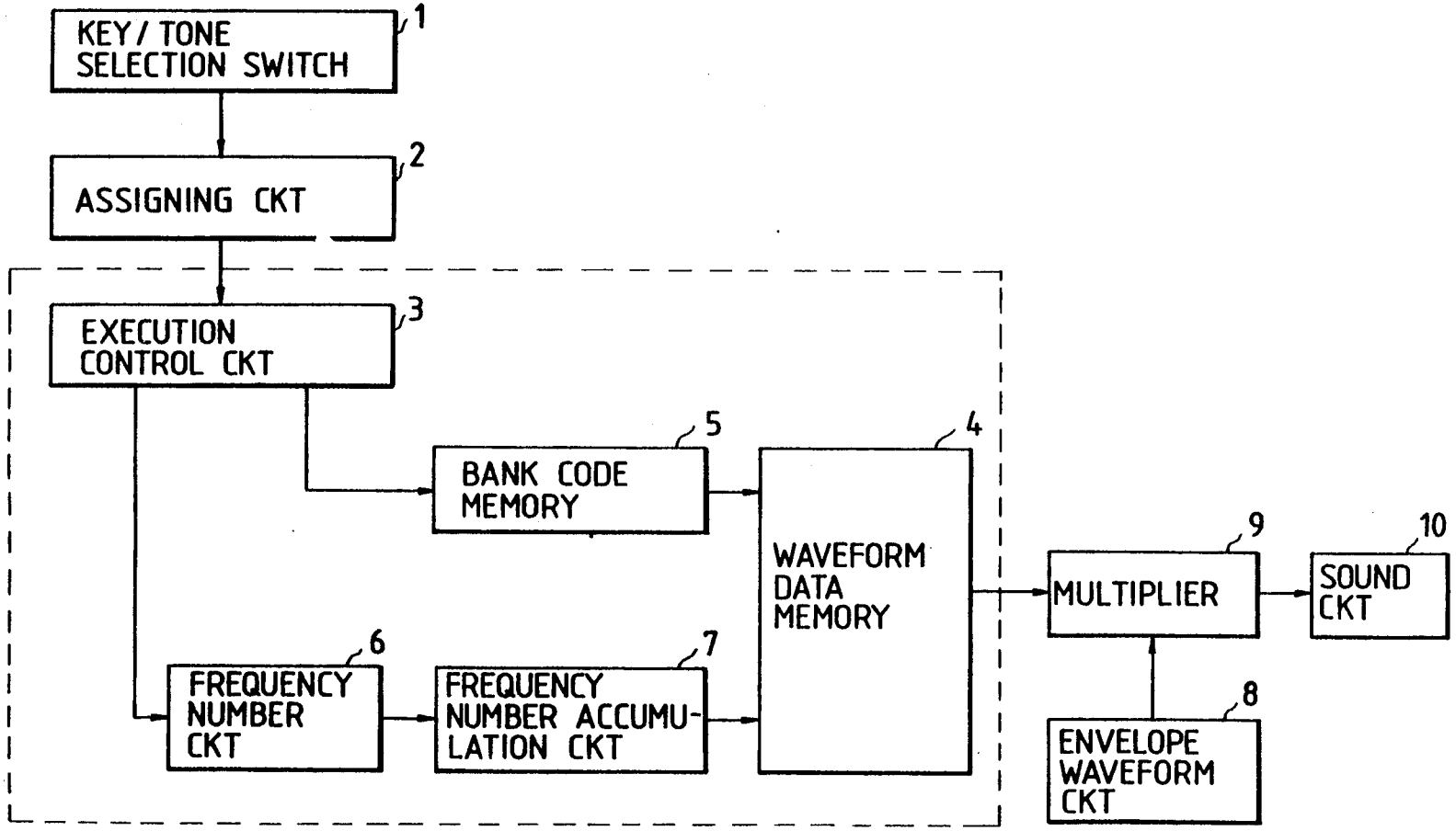
FIG. 1 PRIOR ART
FIG. 1 is a block diagram showing, schematically, a construction of a conventional electronic musical instrument.
Figure 2:
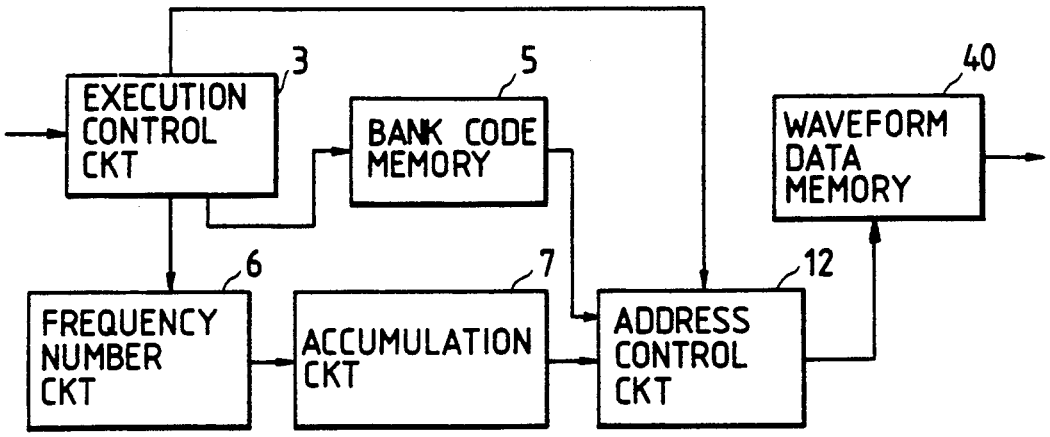
FIG. 2 is a block diagram showing a basic construction of an embodiment of the present invention.

In FIG. 2 which shows a basic construction of the present invention which corresponds to a dotted portion in y of tone selector switches, an assigning circuit 2, a multiplier circuit 9, a sound circuit 10 and an envelope waveform circuit 8 are omitted for simplicity of illustration.

The construction in FIG. 2 includes an execution control circuit 3 responsive to key and tone information obtained by scanning these switches for producing various control signals, a bank code memory 5 and a frequency number circuit 6 responsive to key information and tone information, etc., supplied from the execution control circuit 3 for obtaining frequency numbers and for storing them correspondingly to a plurality of musical sound generators.

The construction further includes an accumulation circuit 7 for accumulating an output of the frequency number circuit 6 to define a predetermined read address range, a waveform data memory 40 which stores preliminarily a number of waveform data of types corresponding to, for example, tones and pitches and an address control circuit 12 responsive to an output value of the accumulation circuit 7 and an output of the bank code memory 5 for reading data preliminarily stored in the waveform data memory 40 by using an address corresponding to the key information and for transforming its address type into the address type in the waveform data memory 40 to control the musical sound generators to produce a desired musical sound.

Since the address control circuit 12 has received control information corresponding to the musical sound generators from the execution control circuit 3, transformation of the type of an address which corresponds to the key information and used to access the waveform data memory 40 into the type to be used in a memory location of the waveform data memory 40 in which a desired waveform data is stored is performed, that is, it is possible to change the address type accessing the waveform data memory 40 correspondingly to the musical sound generator.

It is assumed that the waveform data memory 40 is composed of ROMs, S-RAMs and D-RAMs. When the D-RAMs have different memory capacity, say, 64 K words and 256K words, D-RAMs having memory capacity of 64 K words and those having memory capacity of 256K words are referred to as D-RAM(1) and D-RAM(2), respectively.

It is further assumed that the output of the frequency number circuit 6 is accumulated by the accumulation circuit 7 so that a predetermined memory can be accessed and that 24 bits AB23 to AB0 are obtained at an output of the accumulation circuit 7 and the bank code memory 5.

For ROM or S-RAM, these 24 bits can be provided at an output of the address control circuit 12 as they are as addresses MA23 to MA0.

For D-RAM, it is necessary to perform an access to row address and column address in a multiplex address form having a preceding address half and a subsequent address half. The address control therefor is performed as shown in an address transformation table in FIG. 3. In FIG. 3, a left column of the address transformation table shows a type of memory, AB23 to AB0 are address applied to the address control circuit, MA23 to MA0 in an upper row are the output of the address control circuit 12, i.e., transformed addresses for access to the memory. As will be clear from this table, for D-RAM(1), eight outputs MA7 to MA0 are used for addresses AB15 to AB0 of the applied addresses AB23 to AB0 in the preceding and subsequent address halves and, for D-RAM(2), nine outputs MA8 to MA0 are used for addresses AB17 to AB0 twice similarly.

Figure 4:
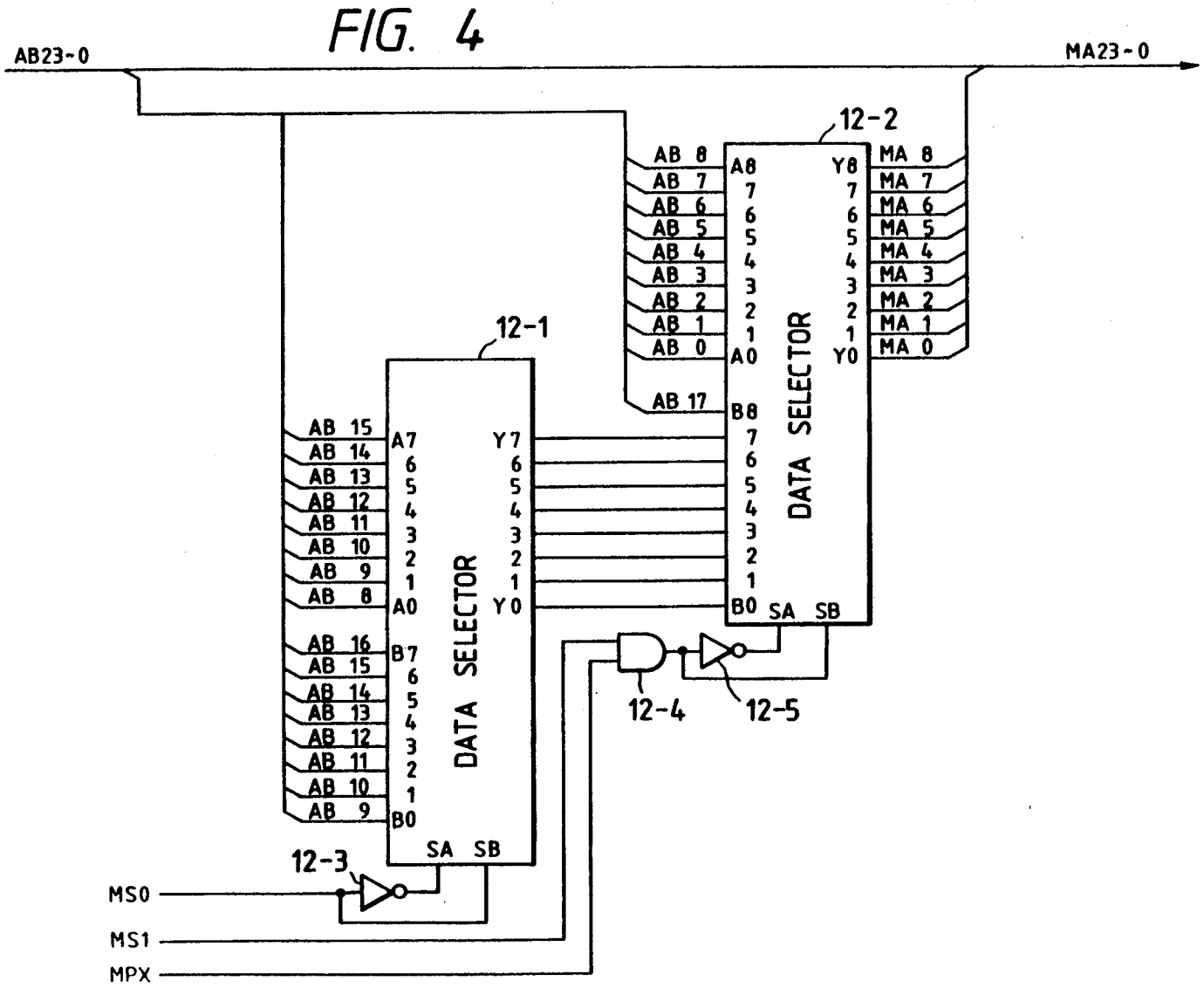
FIG. 4 is a circuit diagram for realizing the table shown in FIG. 3.

FIG. 4 shows an example of a circuit for executing the operation in the table in FIG. 3. In FIG. 4, the circuit comprises data selectors 12-1 and 12-2, an inverter 12-3, an AND circuit 12-4 and another inverter 12-5. MS0, MS1 and MPX are signals for setting addresses according to types of the memory are supplied. The data selector 12-1 has two sets of 8 bit terminals A7 to A0 and B7 to B0, two control terminals SA and SB and one set of 8 bit terminals Y7 to Y0. The data selector 12-2 has two control terminals SA and SB, two sets of 9 bit input terminals A8 to A0 and B8 to B0 and one set of 9 bit output terminals Y8 to Y0. The data selectors 12-1 and 12-2 are controlled by data supplied to the control terminals SA and SB to select the data on the input side and provide it at the output terminal.

The control signals MS0, MS1 and MPX are set for every musical sound generator and control the data selectors according to the type of the memory. The address may be selected such that when MS0 and MS1 are "L", ROM is accessed, when MS0 is "H" and MS1 is "L", S-RAM is accessed, when MS0 is "L" and MS1 is "H", D-RAM(1) is accessed and, when both are "H", D-RAM(2) is accessed.

Figure 5:
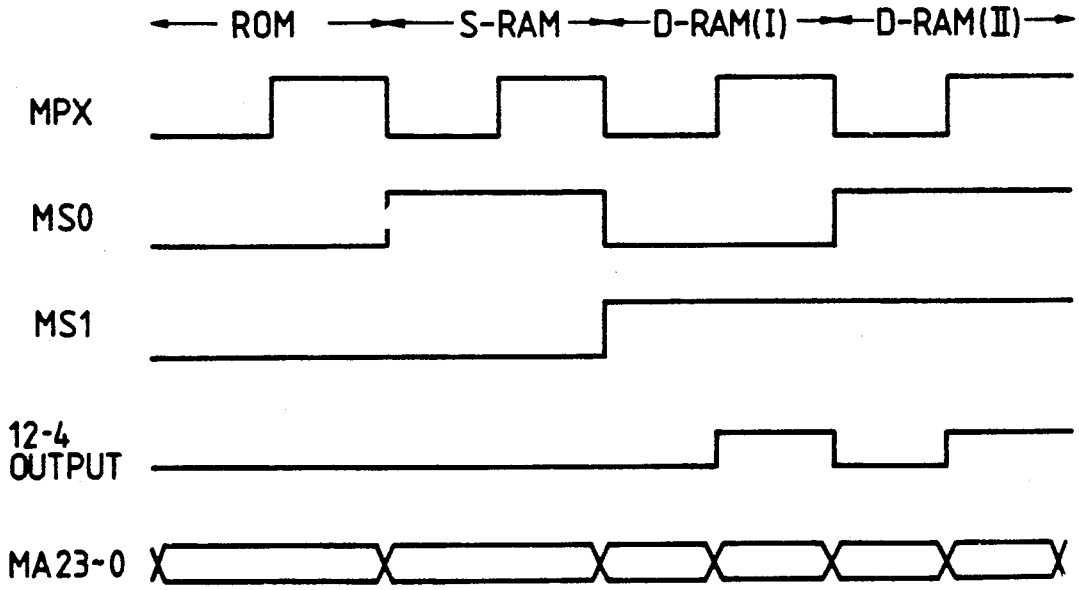
FIG. 5 shows timing diagram of various signals in the circuit in FIG. 2.

When MS0 is "L", address bits AB15 to AB8 are provided at the output terminals Y7 to Y0 of the selector 12-1 and, when MS0 is "H", address bits AB16 to AB9 are provided thereat. That is, the data selector 12-1 is for address of the subsequent half of the multiplex control signal. The address of the subsequent half thus selected, the address bit AB17 and the address bits AB8 to AB0 are subjected to a selection in the data selector 12-2. FIG. 5 shows this address selection performed according to the states of the signals MS1, MS0 and MPX and addresses MA23 to MA0 are provided for the respective memories as shown in the lowest row in FIG. 5.

Figure 6:
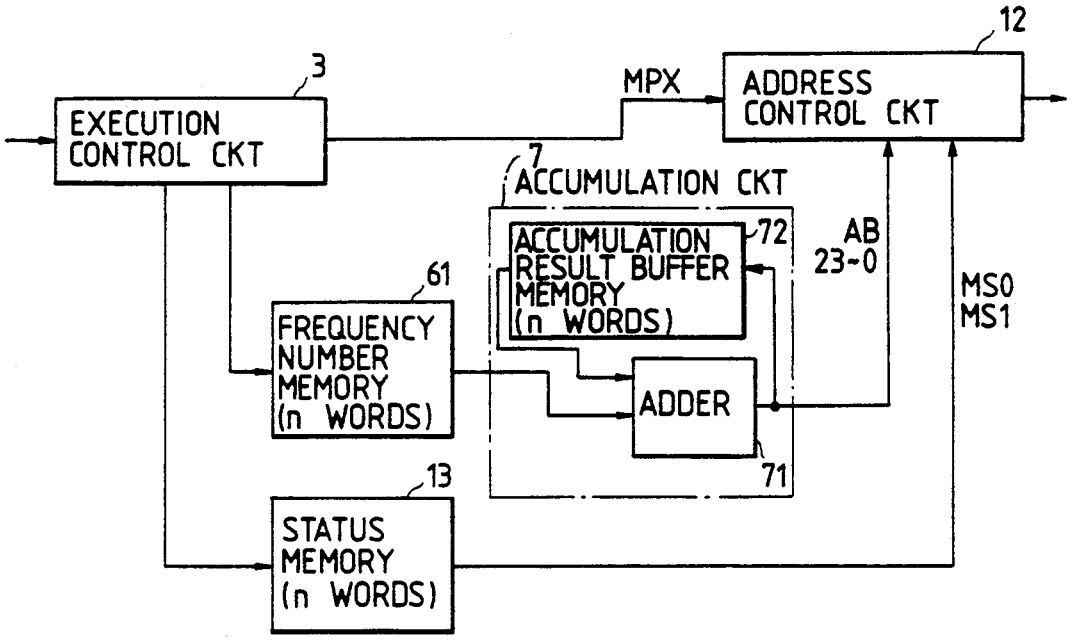
FIG. 6 is a circuit diagram of a detail of the circuit shown in FIG. 2.

FIG. 6 shows another embodiment of the present invention applied to control a plurality (n) of the musical sound generators. In this Figure, components depicted by reference numeral 40 in FIG. 2 are omitted for simplicity of illustration.

In FIG. 6, a status memory 13 having n word numbers is disposed between an execution control circuit 3 and an address control circuit 12. The status memory 13 is a bank memory of word number n. A frequency number memory 61 of word number n is used in FIG. 6 for the frequency number circuit 6 in FIG. 2.

An accumulation means 7 includes an adder 71 and an accumulation result buffer memory 72 of word number n.

The execution control circuit 3 serves to store, in the frequency number memory 61, a frequency number corresponding to key information for every sound generator and to store, in the status memory 13, address type transforming information MS for every sound generator to thereby control the address control circuit 12.

The execution control circuit 3 controls the sound generation in a time sharing manner to obtain a desired musical sound.

Figure 7:
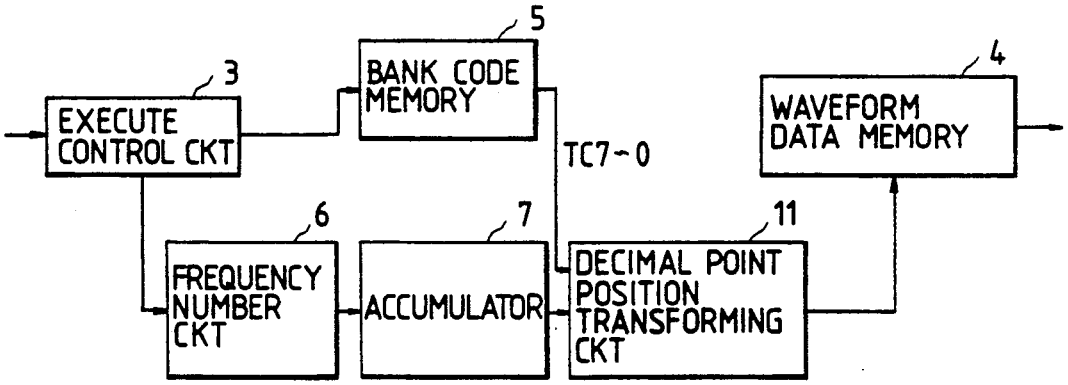
FIG. 7 is a block diagram of another embodiment of the present invention.

FIG. 7 shows another embodiment of the present invention which is similar in circuit construction to the embodiment shown in FIG. 2 except that the address control circuit 12 in FIG. 2 is replaced by a decimal point position transforming circuit 11.

In this embodiment, an address corresponding to key information is divided into an integer portion address and a decimal point portion address. The decimal point position transforming circuit 11 reads the integer portion address and supplies it to a waveform data memory 4 so that the number of address bits for access to the waveform data memory 4 is changed correspondingly to the musical sound generators.

As in the preceding embodiment, the waveform data memory 4 in FIG. 7 has stored a number of waveform data corresponding to tones and pitches in a bank. If necessary, a plurality of such banks are combined in a large bank which is used to store waveform data corresponding to tones and pitches. Key information obtained from the execution control circuit 3 is converted into a frequency number in the frequency number circuit 6 and, then, frequency numbers thus obtained are accumulated in the accumulation circuit 7 so that an output thereof corresponds to a desired sound generator.

The output of the accumulation circuit 7 is supplied to the decimal point position transformer circuit 11 to perform a regulation/transformation of a read address of the waveform data memory 4. This regulation/transformation is necessary to accommodate this system selectively to either a case where the waveform data memory 4 is accessed every bank or a case where the large bank is used. The regulation/ transformation may be done by dividing an address into an integer portion address and a decimal point portion address, reading the integer portion address, sending it as the address and changing the number of address bits of the integer portion address.

Since the number of address bits in access to the waveform data memory 4 is changed to a desired size of bank corresponding to the musical sound generators, it is possible to operate the electronic musical instrument to generate musical sound having changing tone without using a large memory and without making the system size larger.

Figure 8:
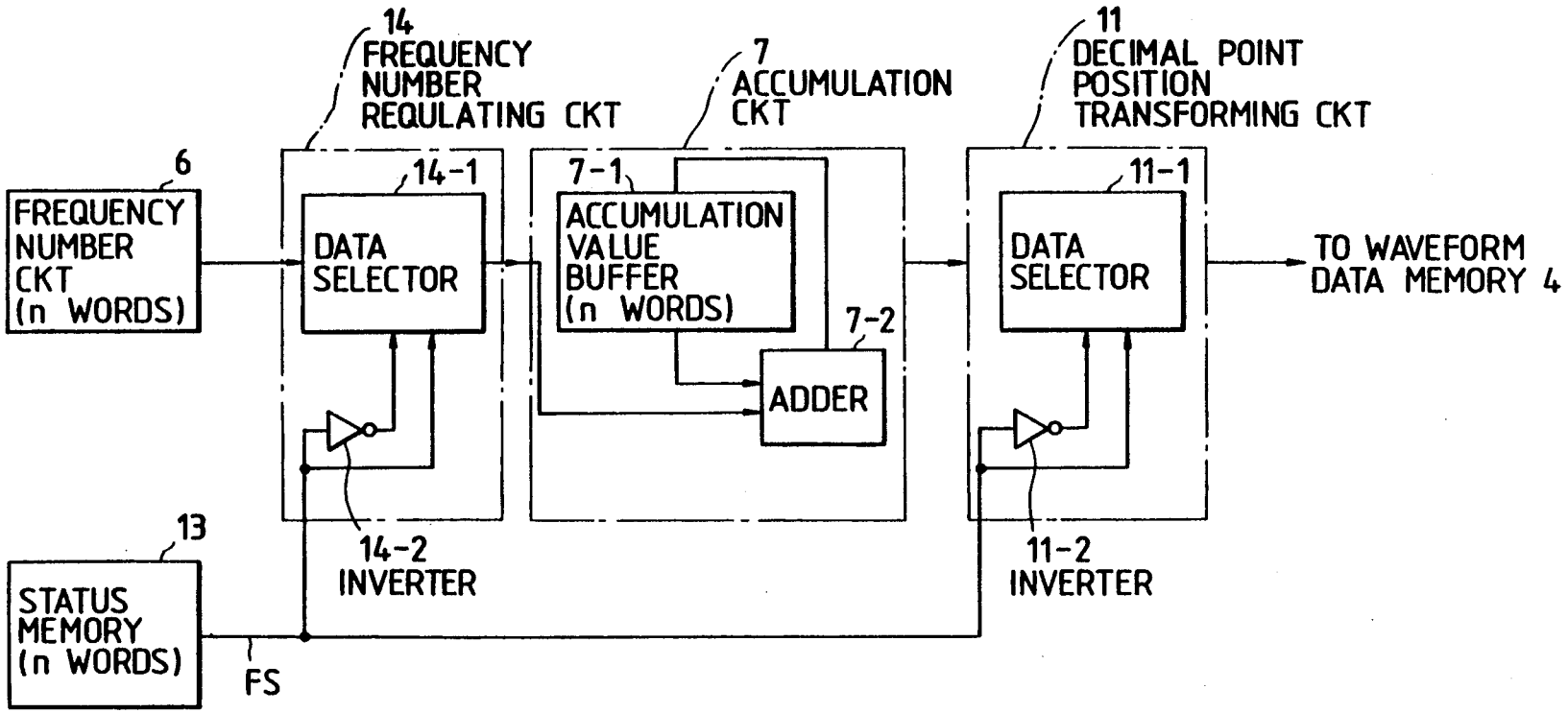
FIG. 8 is a detail of the embodiment shown in FIG. 7.

FIG. 8 shows another embodiment similar to that shown in FIG. 7. In FIG. 8, a reference numeral 11 depicts a decimal point position transforming circuit, 11-1 a data selector in the decimal point position transforming circuit 11, 11-2 an inverter in the decimal point position transforming circuit 11, 13 a status memory, 14 a frequency number regulating circuit, 14-1 a data selector in the frequency number regulating circuit 14 and 14-2 an inverter in the regulating circuit 14.

A memory of word number of n (n is the number of musical sound generators) is used as a frequency number circuit 6 and waveforms which occupy a large space in the waveform data memory 4 and waveforms which do not use a large space in the memory 4 are determined for every sound generator, which are stored in the memory. The status memory 13 comprises a memory of word number n and a signal FS for assigning the aforementioned large capacity bank is made "H" and the signal for a small capacity bank is assigned to "L".

The frequency number regulating circuit 14 which will be described in detail later is composed of the data selector 14-1 and the inverter 14-2, to which signal FS readout from the status memory 13 is applied. And, it is regulated such that waveforms stored in the waveform data memory 4 as having the same frequency number can be readout even if the size of region of one bank of the memory 4 is changed.

The frequency number accumulation circuit 7 is composed of an accumulation value buffer 7-1 of word number n and an adder 7-2 and serves to accumulate addresses regulated or not regulated by the frequency number regulation circuit 14, and outputs an integer as an address for reading out data stored in the waveform data memory 4 and a decimal value produced as a fraction by the accumulation.

The decimal point position transforming circuit 11 which will be described in detail later is composed of the data selector 11-1 and the inverter 11-2. The circuit 11 serves to read the status memory 13 and determine a position of an output address of the accumulation circuit 7 to which a decimal point is assigned according to a signal FS similar to the signal applied to the frequency number regulating circuit 14. Then, the circuit 11 determines a readout address for the waveform data memory 40 by attaching a bank code (TC7 to TC0) to an upper portion. With a connection of the data selector 11-1, an address is shifted by, for example, 4 bits to change the readout address.

Figure 9A:
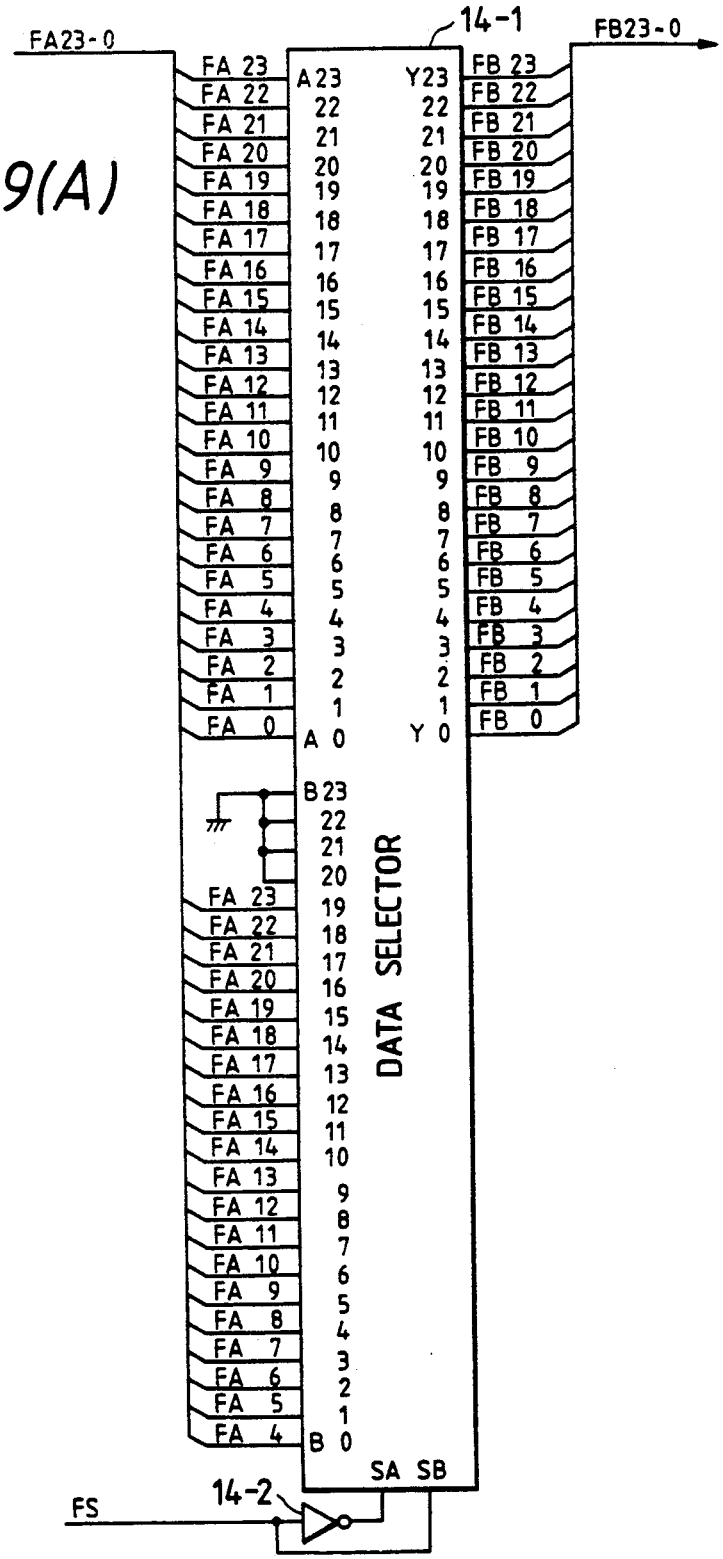
FIG. 9A shows a detail of a data selector shown in FIG. 8.
Figure 9B:
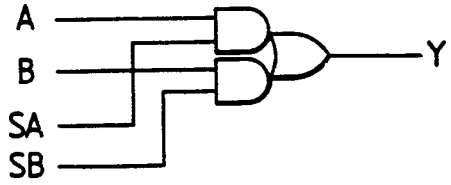
FIG. 9B shows a detail of an internal circuit portion of a data selector shown in FIG. 9A.

FIG. 9A shows the data selector 14-1 and the inverter 14-2 of the frequency number regulator 14 in detail. In FIG. 9A, the data selector 14-1 comprises a multi-terminal logic circuit. A signal from a terminal FS is supplied through the inverter 14-2 to a terminal SA and directly to a terminal SB of the data selector 14-1. When FS ="L", input data A23 to A0 are outputted as they are as outputs Y23 to Y0 of the data selector. When FS ="H", input data B23 to B0 are provided as outputs Y23 to Y0. A relation between the input one bit terminal data A and B and the terminals SA and SB is shown in FIG. 9B. The input FA to the terminals B23 to B20 is shifted by 4 bits so that they are always kept at grounding potential, as shown in FIG. 9A. The input FA which is the output of the frequency number circuit 6 is outputted as FA23 to FA0 or 1/16 thereof depending upon condition of the terminal FS.

Figure 10:
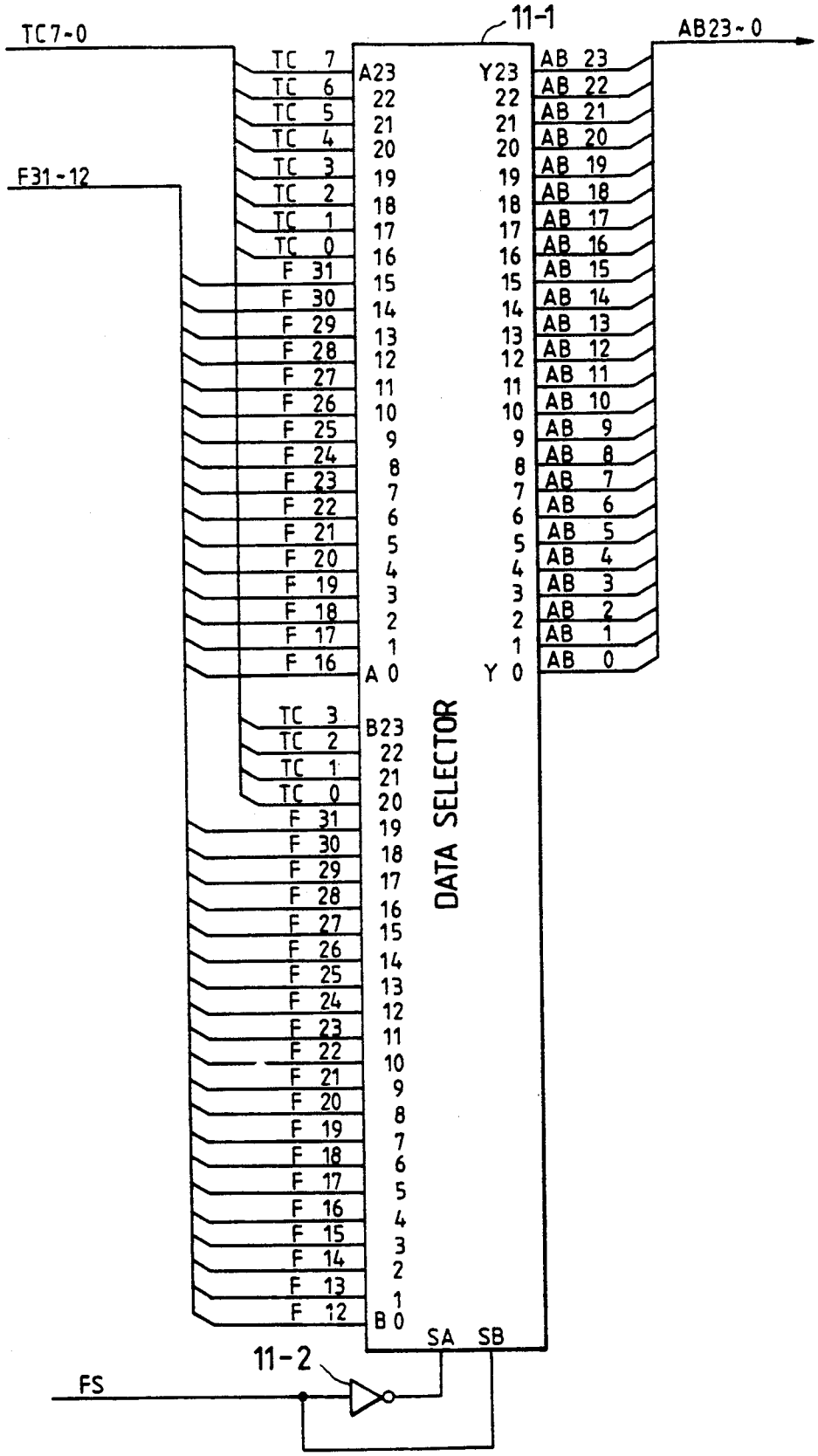
FIG. 10 is a detail of another data selector shown in FIG. 8.
Figures 11, 13:
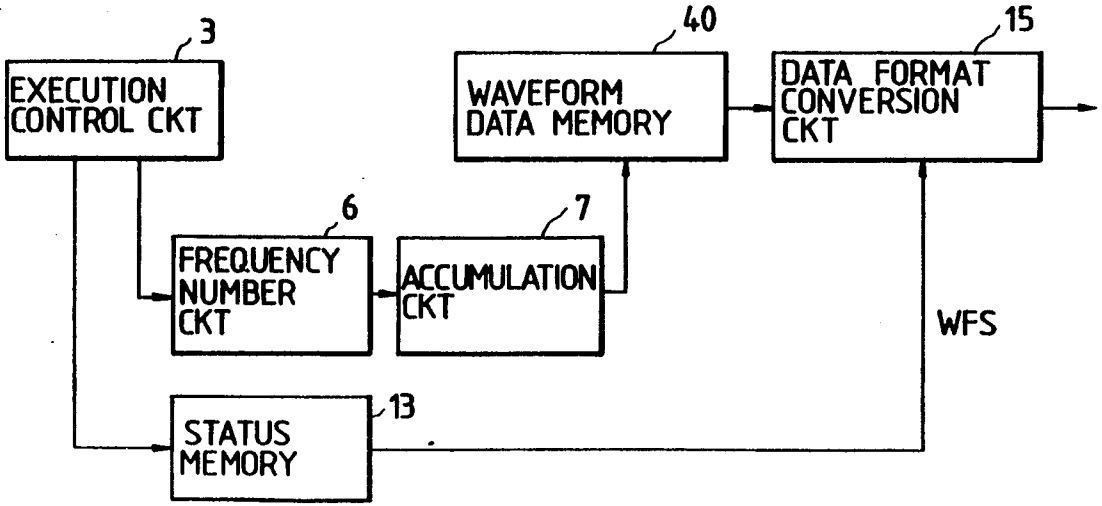
FIG. 11 is a table of outputs of a data selector in FIG. 10.
FIG. 13 shows another embodiment of the present invention.

FIG. 10 shows the decimal point position transforming circuit 12 in detail. A data selector 11-1 shown in FIG. 10 is similar to the data selector 14-1 in FIG. 9. In FIG. 10, signals TC7 to TC0 contain data readout from the bank code memory. When the signal FS ="L", the inputs A23 to A0 are outputted at Y23 to Y0 and, when FS ="H", the inputs B23 to B0 are outputted at the outputs Y23 to Y0. Therefore, it is possible to select either the data TC7 to TC0 readout from the bank code memory 5 or the output address of the address accumulation circuit 7 depending upon condition of the FS. The selection is shown in FIG. 11. In FIG. 11, TC7 to TC0 are bank code as mentioned, F31 to F12 are outputs of the address accumulating circuit 7 and AB23 to AB0 are outputs of the data selector 11-1. That is, when FS ="L", the decimal point is set between F16 and F15, in other words, respective bits higher than F16 means the address integer portion. When FS="H", the decimal point is set in between F12 and F11, in other words, respective bits higher than F12 means address integer portion. Therefore, the accuracy of frequency reading out the waveform data when FS ="H" is somewhat degraded compared with the case of FS ="L".

Figure 12:
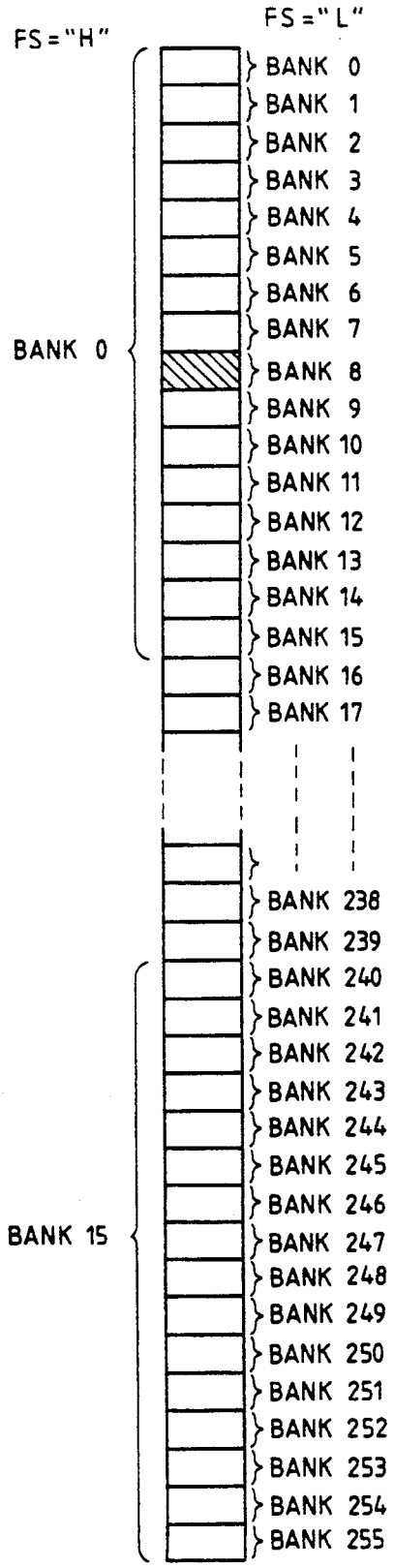
FIG. 12 shows bank regions of the waveform data memory in FIG. 7.

FIG. 12 shows bank regions in a waveform data memory 40. In FIG. 12, a hatched portion shows a bank No. 8 of 64 K words. The memory which has bank 0 to bank 255, each bank including a region of 64 K words when the signal="L". The memory which has bank 0 to bank 15, each bank including a region of 1 M words when FS="H". Therefore, when 256 banks each of 64 K words are addressed, FS="L" and, when 16 banks each of 1 M words are addressed, FS="H". The 4 bits shift obtained by changing the scale of bank is a mere example and any other change may be possible.

FIG. 13 shows another embodiment of the present invention. In FIG. 13, a reference numeral 3 depicts an execution control circuit, 40 a waveform data memory, 6 a frequency number circuit, 7 a frequency number accumulation circuit, 13 a status memory and 15 a data format conversion circuit. The data format conversion circuit 15 serves to convert the data format of a desired waveform readout from the waveform data memory 40 correspondingly to the sound generators.

The waveform data memory 40 shown in FIG. 13 has stored a number of waveforms in correspondence to, for example, tones and pitches. A frequency number is obtained in the frequency number circuit 6 according to key information and tone information supplied from the execution control circuit 3, which is accumulated in the frequency number accumulation circuit 7 to make it in a desired readout address. Then, the waveform data memory 40 is read by an output value of the accumulation circuit 7. The waveform data readout from the waveform data memory 40 is supplied to the data format conversion circuit 15. The waveform data is converted into data into, for example, linear expression even when the waveform data is expressed by a different expression such as a linear data of 16 bits or a combination of a linear 16 bits data and data represented by exponential expression. This conversion is preferably performed for every musical sound generator so that data format conversion control signal (WFS) from the status memory 13 is obtained for every sound generator. For this, a multiplier circuit may be used to add an envelope to the output value of the data format conversion circuit 15.

Figure 14A:
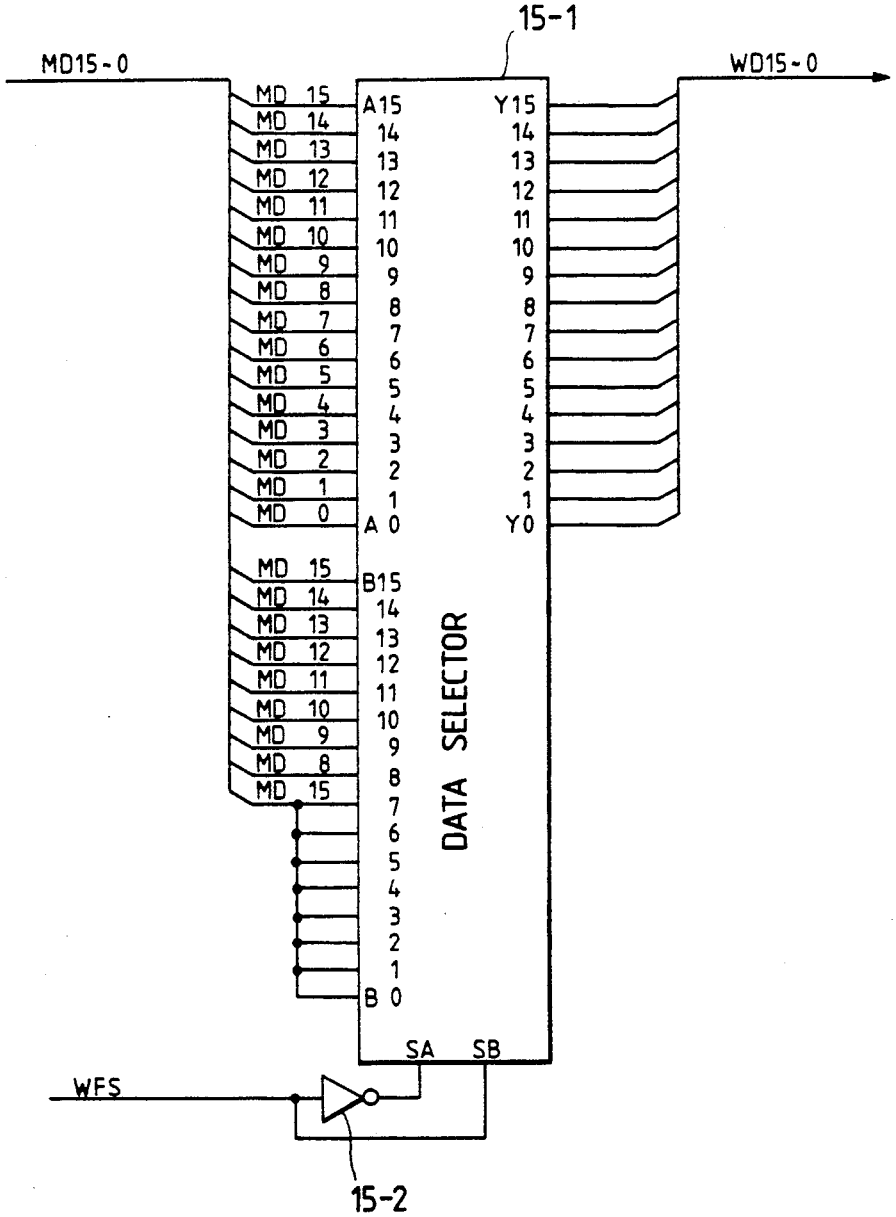
FIG. 14A is a detail of a data format conversion circuit in FIG. 13.

FIG. 14 shows the data format conversion circuit 15 in FIG. 13 in detail. In FIG. 14A, a reference numeral 15-1 depicts a data selector and 15-2 an inverter. Depending upon a signal WFS applied to the data selector 15-1 through the inverter 15-2, the input data are outputted as they are or are converted in format. That is, when WFS="L", the input data MD15 to MD0 become the output data WD15 to WD0, respectively, i.e., the linear 16 bits input is used as a linear 16 bits output. When WFS="H", the waveform data MD15 to MD0 are outputted with MD15 to MD8 being higher significant bits and MD7 to MD0 being lower significant bits with MD15 as a sign bit.

Figure 14B:
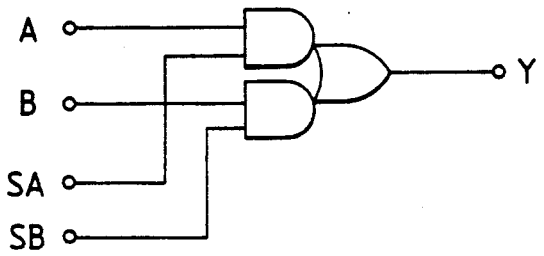
FIG. 14B is a detail of an internal circuit portion of a data format conversion circuit in FIG. 14A.

FIG. 14B shows an inner circuit of the data selector for each bit. That is, this circuit can be constituted with AND gates and an OR gate.

Figure 15:
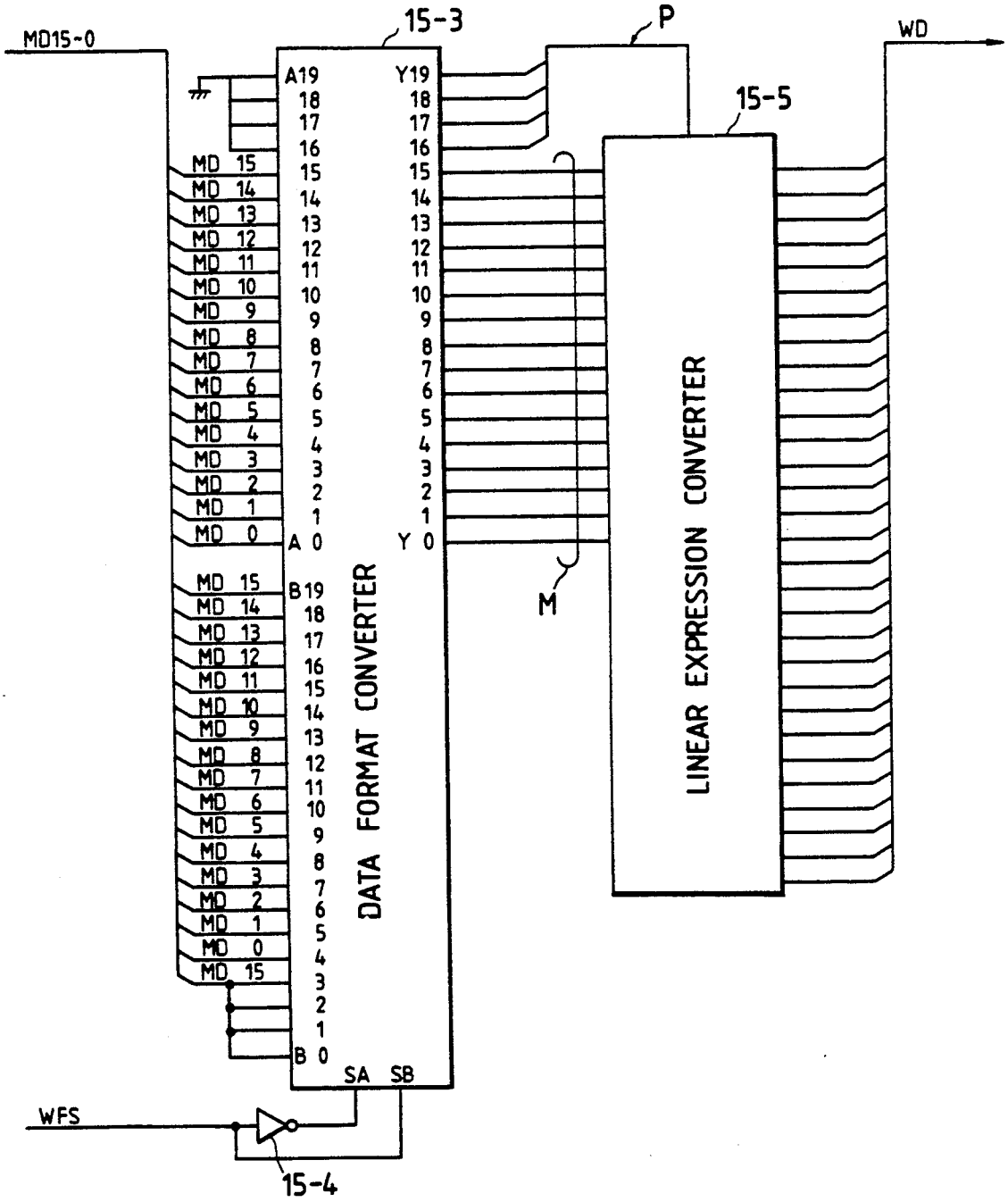
FIG. 15 shows another embodiment of the data format conversion circuit shown in FIG. 13.

FIG. 15 shows another example of the data format conversion circuit 15 shown in FIG. 13. In FIG. 15, a reference numeral 15-3 depicts a data selector, 15-4 an inverter and 15-5 a converter for converting the format into linear expression. When the input data is a mixture of a linear 16 bits data and exponential 16 bits data including a 12 bits mantissa and a 4 bits exponential portion, an exponential data $M \times 2^{-P}$ is obtained from the data conversion circuit 15-3 as general data, in response to "L" and "H" states of the signal WFS.

Expressing data Y15 to Y0 to be linear-converted by the converter 15-5 by M15 to M0, data M15 to M0 are shifted according to an exponential portion P expressed by Y19 to Y16 as shown in FIG. 16. That is, a data in linear expression is obtained.

The signal WFS is preliminarily determined for every musical sound generator and stored in the status memory. The signal WFS is readout from the memory and applied to the data format conversion circuit 15. Alternatively, it may be stored in the status memory correspondingly to tone and compass (pitch), readout therefrom and applied to the data format conversion circuit 15.

Figure 17:
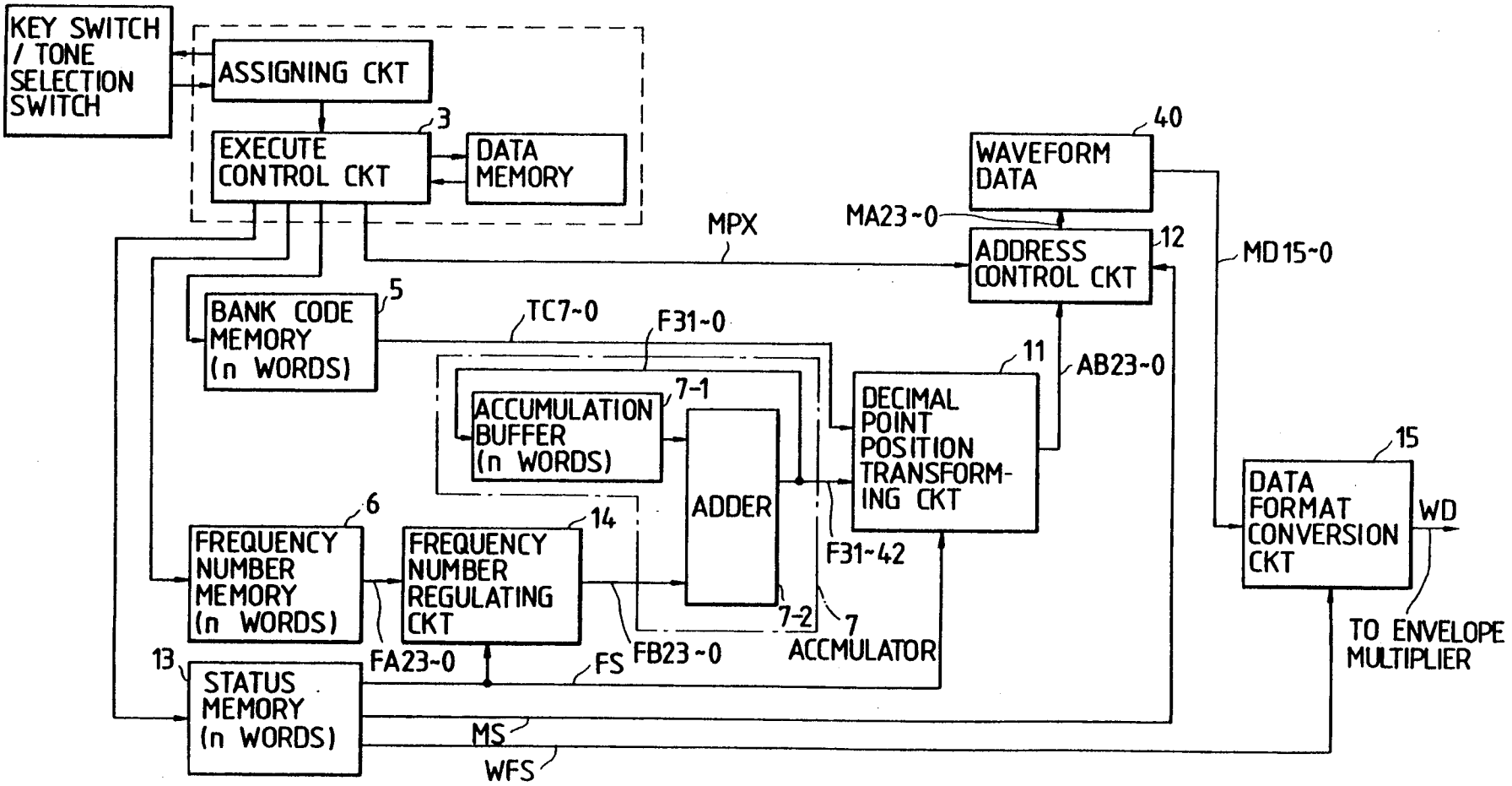
FIG. 17 shows another embodiment of the present invention.

FIG. 17 shows the construction of this system, different portions of which have been described, as a whole. In FIG. 17, a reference numeral 5 depicts the bank code memory, 11 the decimal point position transforming circuit, 2 the address control circuit, 13 the status memory, 14 the frequency number regulating circuit, 15 the data format conversion circuit and 40 the waveform data memory.

The bank code memory 5 stores codes for assigning bank regions corresponding to the respective musical sound generators. The stored data are readout to assign regions stored in the waveform data memory 40.

Figure 18:
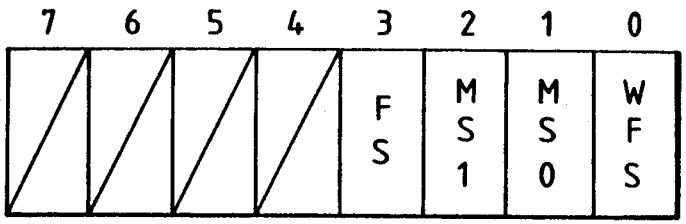
FIG. 18 shows an example of one word construction in a status memory in FIG. 17.

The status memory 13 stores information signal (FS) for changing read size of a unit bank region in the waveform data memory 40, information signal (MS) for changing an address bit number according to a memory address format contained in the waveform data memory 40 and information signal (WFS) for changing waveform data according to the waveform data format in the same memory and picking it up as musical sound waveform data, correspondingly to the respective musical sound generators. FIG. 18 shows an example of one word of the status memory 13. In FIG. 18, the informations WFS, FS and MS are stored in bit 0 to bit 3, respectively. Bit 4 and subsequent bits are used to store control data for other portions, not shown. The status memory receives key information and tone information supplied from the execution control circuit 3. The status memory serves to decode these informations by means of the address decoder. Words in desired positions are readout according to resultant address and outputted. Alternatively, it is possible to use frequency information instead of key information so that a plurality of keys can be grouped and made an information.

Figure 19:
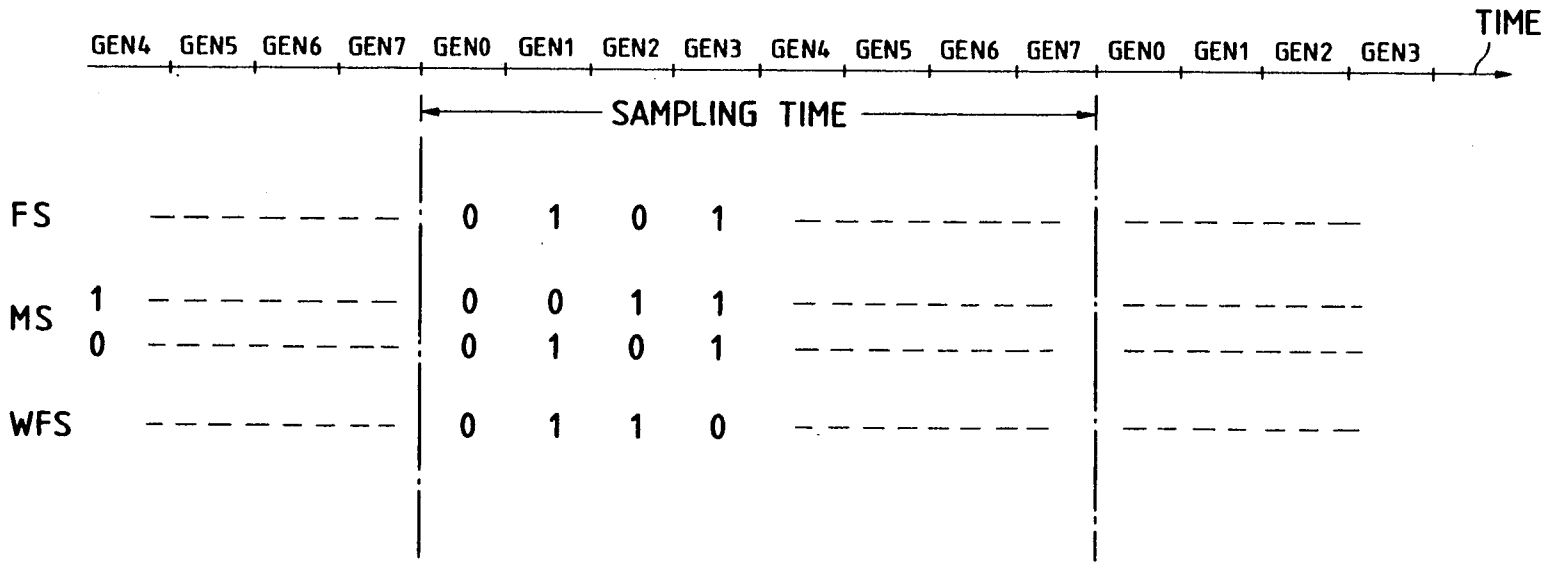
FIG. 19 illustrates a control operation of the present invention shown in FIG. 17 in which eight musical sound generators are used.

FIG. 19 shows a control of information FS, MS and WFS with time, when eight musical sound generators are used. One sampling time of this system is a sum of identical operation times of the musical sound generators GEN0 to GEN7. The respective information values of one word shown in FIG. 18 are put vertically for every sound generator. Thus, the respective information signals are set in a different manner for every sound generator or in the same manner for all generators.

As described, according to the present invention, the design of a system becomes very easy because the waveform data memory can be selected and used correspondingly to the musical sound generators by setting an address regardless of the kind of waveform data memory, ROM or D-RAM.

Further, it is possible to selectively set and execute an operation with the size of a storage bank for a musical sound waveform data being enlarged or unchanged.

Since this system can be operated commonly even if the data format of the waveform data memory is different, it is possible to easily obtain an improved sound quality by selecting a data format correspondingly to tone. Further, since the data format can be controlled for every musical sound generator, compression of waveform data can be done suitably.

What is claimed is:

1. An electronic musical instrument comprising:

a key board having a plurality of keys, each of which when actuated defines respective key information, a plurality of tone selection switches for setting desired tones, a control means responsive to said key information and tone information obtained by scanning said keys and said tone selection switches for supplying control signals, a plurality of musical sound generators each of which corresponds to respective key information, a frequency number means, responsive to a control signal from said control means, for generating a frequency number corresponding to the key information corresponding to a respective one of said musical sound generators, accumulation means for receiving and accumulating output values of said frequency number means, a waveform data memory for storing waveform data according to an address corresponding to the key information, said waveform data being readout to generate desired musical sound from a respective one of said musical sound generators, said waveform data memory comprising a plurality of different types of memories, and an address control means for converting the address corresponding to the key information into an address format for a location of one of said plurality of different types of memories in said waveform data memory in which said desired waveform data is stored, said address control means being adapted to be controlled by said control means to change said address format for access to said waveform data memory corresponding to a respective one of said musical sound generators.

2. An electronic musical instrument comprising:

a key board having a plurality of keys, each of which when actuated defines respective key information, a plurality of tone selection switches for setting desired tones, a control means responsive to said key information and tone information obtained by scanning said keys and said tone selection switches for supplying control signals, a plurality of musical sound generators each of which corresponds to respective key information, a frequency number means, responsive to a control signal from said control means, for generating a frequency number corresponding to the key information corresponding to a respective one of said musical sound generators, accumulation means for receiving and accumulating output values of said frequency number means, a waveform data memory for storing waveform data according to an address corresponding to the key information, said waveform data being readout to generate desired musical sound from a respective one of said musical sound generators, an address control means for converting the address corresponding to the key information into an address format for a location of said waveform data memory in which said desired waveform data is stored, said address control means being adapted to be controlled by said control means to change said address format for access to said waveform data memory corresponding to a respective one of said musical sound generators, and a decimal point position converting means for dividing the address corresponding to the key information into an integer portion address and a decimal point portion address, said integer portion address being readout and sent to said waveform data memory as a read address, wherein a number of bits of the address for accessing said waveform data memory is changed corresponding to a respective one of said musical sound generators.

3. The electronic musical instrument claimed in claim 2, further comprising a memory comprising a plurality of regions, said memory storing a frequency number corresponding to the key information corresponding to a respective one of said musical sound generators, and wherein said electronic musical instrument further comprises a regulating means for regulating an output data obtained by reading said memory so that said output data can be changed corresponding to a region size of said waveform data memory.

4. An electronic musical instrument comprising:

a key board having a plurality of keys, each of which when actuated defines respective key information, a plurality of tone selection switches for setting desired tones, a control means responsive to said key information and tone information obtained by scanning said keys and said tone selection switches for supplying control signals, a plurality of musical sound generators each of which corresponds to respective key information, a frequency number means, responsive to a control signal from said control means, for generating a frequency number corresponding to the key information corresponding to a respective one of said musical sound generators, accumulation means for receiving and accumulating output values of said frequency number means, a waveform data memory for storing waveform data according to an address corresponding to the key information, said waveform data being readout to generate desired musical sound from a respective one of said musical sound generators, an address control means for converting the address corresponding to the key information into an address format for a location of said waveform data memory in which said desired waveform data is stored, said address control means being adapted to be controlled by said control means to change said address format for access to said waveform data memory corresponding to a respective one of said musical sound generators, and a data format converter means for converting a data format of said desired waveform data readout from said waveform data memory so that said data readout from said waveform data memory is converted so as to correspond to a respective one of said musical sound generators.

5. The electronic musical instrument claimed in claim 4, wherein said data format converter means converts said data format of said desired waveform data readout from said waveform data memory according to a desired tone or pitch.

6. An electronic musical instrument comprising:

a key board having a plurality of keys, each of which when actuated define respective key information, a plurality of tone selection switches for setting desired tones, a control means responsive to said key information and tone information obtained by scanning said keys and said tone selection switches for supplying control signals, a plurality of musical sound generators, each of which correspond to respective key information, a frequency number means, responsive to a control signal from said control means, for generating a frequency number corresponding to the key information corresponding to a respective one of said musical sound generators, accumulation means for receiving and accumulating output values from said frequency number circuit, a waveform data memory for storing waveform data according to an address corresponding to the key information, said waveform data being readout to generate desired musical sound from respective ones of said musical sound generators, said waveform data memory comprising a plurality of different types of memories, and a decimal point position converting means for dividing the address corresponding to the key information into an integer portion address and a decimal point portion address, said integer portion address being readout and sent to said waveform data memory as a read address, wherein a number of bits of said address for accessing said waveform data memory is changed corresponding to a respective one of said musical sound generators, an address control means for converting the address corresponding to the key information into an address format for a location of one of said plurality of different types of memories in said waveform data memory in which said desired waveform data is stored, a data format converter means for converting a data format of said desired waveform data readout from said waveform data memory so that said data readout from said waveform data memory is converted corresponding to a respective one of said musical sound generators, and a status memory, coupled to said control means and said address control means, for storing control data for controlling operations of said decimal point position converting means, said address control means, and said data format converter means.

* * * * *